US010232246B2

(12) United States Patent
Gallay

(10) Patent No.: US 10,232,246 B2
(45) Date of Patent: Mar. 19, 2019

(54) MESH FOR A SNOWSHOE

(71) Applicant: Philippe Gallay, La Clusaz (FR)

(72) Inventor: Philippe Gallay, La Clusaz (FR)

( * ) Notice: Subject to any disclaimer, the term of this patent is extended or adjusted under 35 U.S.C. 154(b) by 194 days.

(21) Appl. No.: 14/651,864

(22) PCT Filed: Dec. 12, 2013

(86) PCT No.: PCT/FR2013/053049

§ 371 (c)(1),
(2) Date: Oct. 5, 2015

(87) PCT Pub. No.: WO2014/091163

PCT Pub. Date: Jun. 19, 2014

(65) Prior Publication Data

US 2016/0051887 A1 Feb. 25, 2016

(30) Foreign Application Priority Data

Dec. 13, 2012 (FR) ..... 12 62008

(51) Int. Cl.
*A63C 13/00* (2006.01)

(52) U.S. Cl.
CPC ..... *A63C 13/005* (2013.01); *A63C 13/001* (2013.01); *A63C 13/003* (2013.01)

(58) Field of Classification Search
CPC ... A63C 13/001; A63C 13/005; A63C 13/006; A63C 13/003
See application file for complete search history.

(56) References Cited

U.S. PATENT DOCUMENTS

| | | | | |
|---|---|---|---|---|
| 405,516 A * | 6/1889 | Watson | ..... | A63C 13/001 280/600 |
| 3,599,352 A * | 8/1971 | Novak | ..... | A63C 13/005 36/123 |
| 3,636,643 A * | 1/1972 | Lundquist | ..... | A63C 13/001 36/123 |

(Continued)

FOREIGN PATENT DOCUMENTS

| | | | | |
|---|---|---|---|---|
| FR | 2901711 A1 * | 12/2007 | ..... | A63C 13/005 |
| WO | 95/06502 | 3/1995 | | |
| WO | 97/28860 | 8/1997 | | |

OTHER PUBLICATIONS

Int'l Search Report conducted in Int'l Appln. No. PCT/FR2013/053049 (dated Mar. 24, 2014) (in English and French languages).

*Primary Examiner* — Jila M Mohandesi
(74) *Attorney, Agent, or Firm* — Greenblum & Bernstein, P.L.C.

(57) ABSTRACT

A snowshoe (1) in the form of an elongated plate called a mesh, onto which a fastener (3) is mounted, intended to hold the shoe of the user in place, the mesh being formed by an elongated plate comprising a front portion (6) called a spatula (6) extended rearward (AR) by a rear part, formed by a central portion (5) extended by a rear portion (7), the front portion (6) being curved upward to form the spatula, characterized in that the rear part is flexible at least longitudinally and at least in the central portion (5), while the front portion (6) of the mesh is rigid so as to be less flexible than the rear part, i.e. the other portions, particularly the central portion and the rear portion.

16 Claims, 8 Drawing Sheets

(56) References Cited

U.S. PATENT DOCUMENTS

| | | | | | |
|---|---|---|---|---|---|
| 4,045,889 | A * | 9/1977 | Woolworth | A63C 13/003 | 36/122 |
| 4,720,927 | A | 1/1988 | Abegg | | |
| 5,459,950 | A * | 10/1995 | Damm | A63C 13/006 | 36/122 |
| 5,493,794 | A * | 2/1996 | McKenzie | A63C 13/001 | 36/122 |
| 5,720,120 | A | 2/1998 | Ramboz | | |
| 6,006,453 | A * | 12/1999 | Klebahn | A63C 13/003 | 36/123 |
| 6,112,436 | A * | 9/2000 | Quellais | A43C 15/09 | 36/124 |
| 9,308,434 | B2 * | 4/2016 | Ostor | A63C 13/005 | |
| 2009/0172974 | A1 * | 7/2009 | Faber | A63C 13/005 | 36/124 |
| 2010/0126046 | A1 * | 5/2010 | Samuels | A63C 13/006 | 36/122 |
| 2011/0079986 | A1 * | 4/2011 | Gradman | A63C 5/02 | 280/609 |

* cited by examiner

MESH FOR A SNOWSHOE

The present invention relates to a snowshoe, and more particularly an improvement of its deck.

Snowshoes are devices that have been known for a number of years, as they have been used by Scandinavian populations for several centuries to move on snow. Up to now, snowshoes had been used for utilitarian or military purposes, to enable populations and alpine troops to move on snow for their travel requirements of daily life. At present, snowshoes are instead used by athletes for hiking and walking, and even for competitions. But such athletes, although practicing for pleasure, are becoming increasingly demanding with respect to the equipment that they use, and it is true that the products currently sold are not entirely satisfactory, particularly when moving on snow.

The present invention provides a novel snowshoe combining retention and comfort in both the ascent and the descent.

The snowshoe of the invention is in the form of an elongated plate called the deck onto which a binding is mounted, adapted to retain the boot of the user, the deck being formed of an elongated plate comprising a front portion referred to as the tip, extended rearward by a rear part, formed of a central portion extended by a rear portion, the front portion being curved upward to form the tip, is characterized in that the rear part is flexible at least longitudinally and at least in the central portion, while the front portion of the deck is rigid so as to be less flexible than the rear part, i.e., the other portions, including the central portion and the rear portion.

According to an additional characteristic, the deck has longitudinal flexibility that enables it to become deformed along a continuous curve, while the flexibility of the central portion is such that the deflection is for example equal to or greater than 5% of the length of the central portion.

Notably, the deck is flexible transversely, with its central portion being flexible in all directions, in order to give maximum comfort to the user of the snowshoe, through adaptation of the lower surface of the deck to the geometry of the snow surface.

Additionally, the deck is made of a deformable material, such as polypropylene or polyethylene, or even polyamide or polyurethane.

Notably, the deck comprises complementary elastically deformable elements with shape memory, adapted to return the deck to its original shape after deformation.

To this end, the complementary elements are longitudinal lateral strips comprised of layers of composite materials, or are elastically deformable longitudinal rods.

According to the preferred embodiment, the complementary elements are fixed to the upper surface of the deck, although not affixed to the deck over their entire length but only at a point or over a short length, while the portions of the element that are not affixed to the deck remain free, at least in longitudinal relative displacement with respect to the deck surface.

Advantageously, the deck comprises a set of crampons advantageously located beneath the lower surface of the deck and in the area of the central portion in which the zone occupied by the boot is located, as well as transverse ribs arranged beneath the lower surface of the deck in the central portion occupied by the boot.

It is understood that the deformation of the deck then enables good foot rolling movement during walking, and the user moves on snow with maximum comfort and, therefore, with minimum expense of energy. Moreover, during downhill displacement, particularly in powdery snow, the adaptation of the shape of the deck provides real comfort and increased safety, due to the position of the foot relative to the slope.

Notable is that the heel of the user pressing on the rear crampons provides excellent grip on hard snow due to the rear crampons.

Other characteristics and advantages of the invention will become apparent from the following description, with reference to the annexed drawings given by way of non-limiting examples, in which.

Figure 10:
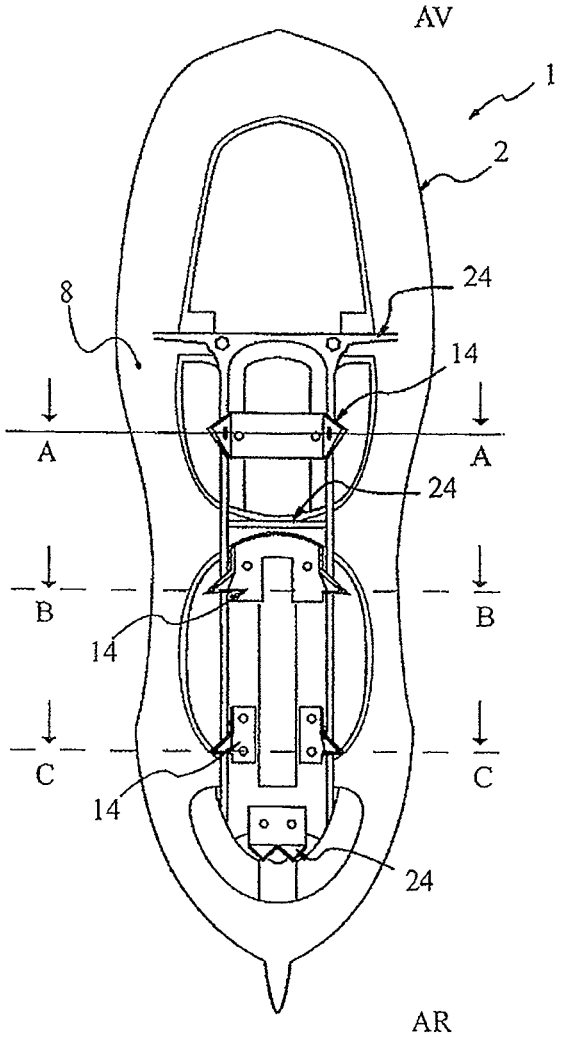
FIG. 10 is a bottom view of the deck.
Figure 10A:
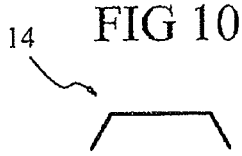
Figure 10B:
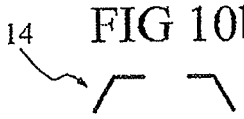
Figure 10C:
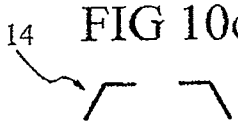

FIGS. 10*a*, 10*b*, 10*c* are cross-sectional views along the lines A-A, B-B, and C-C, respectively.

Figure 11:
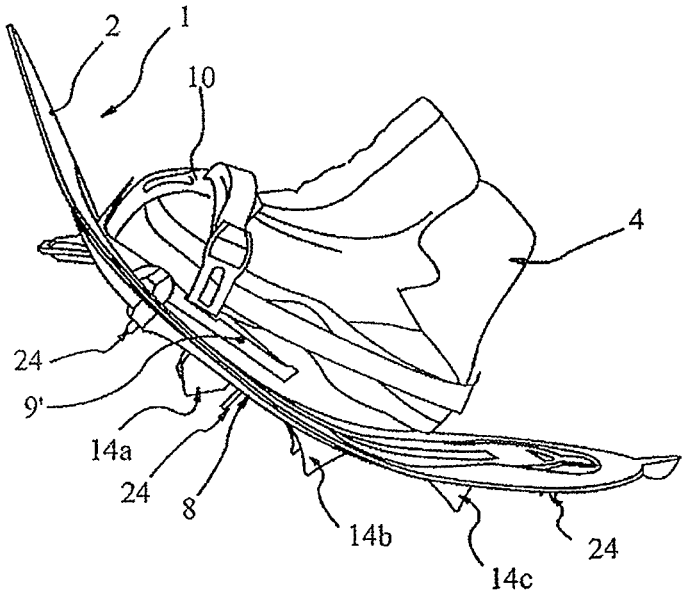

FIG. 11 is a lateral view showing the snowshoe with another type of boot retention.

Figure 12:
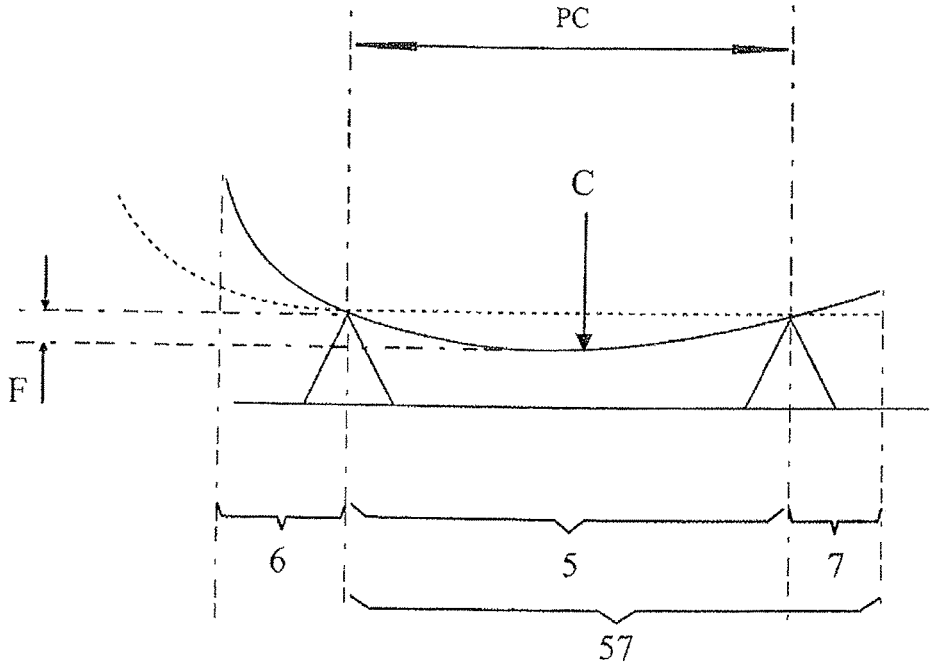
Figure 13:
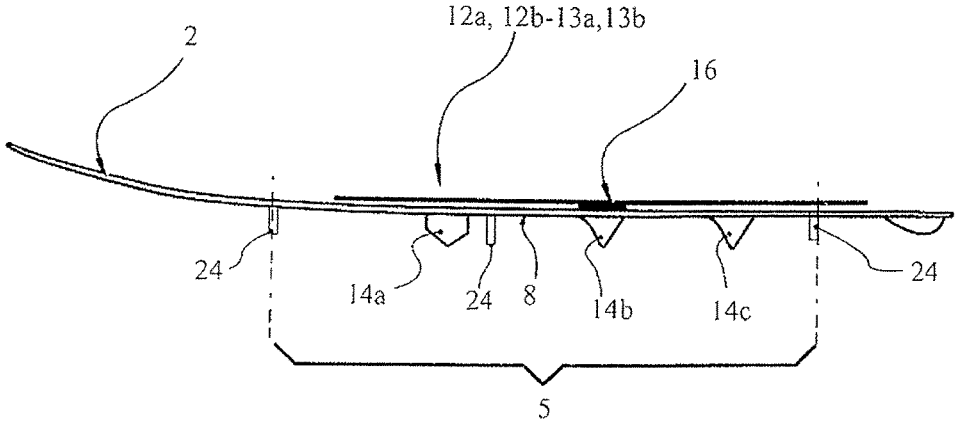
Figure 14:
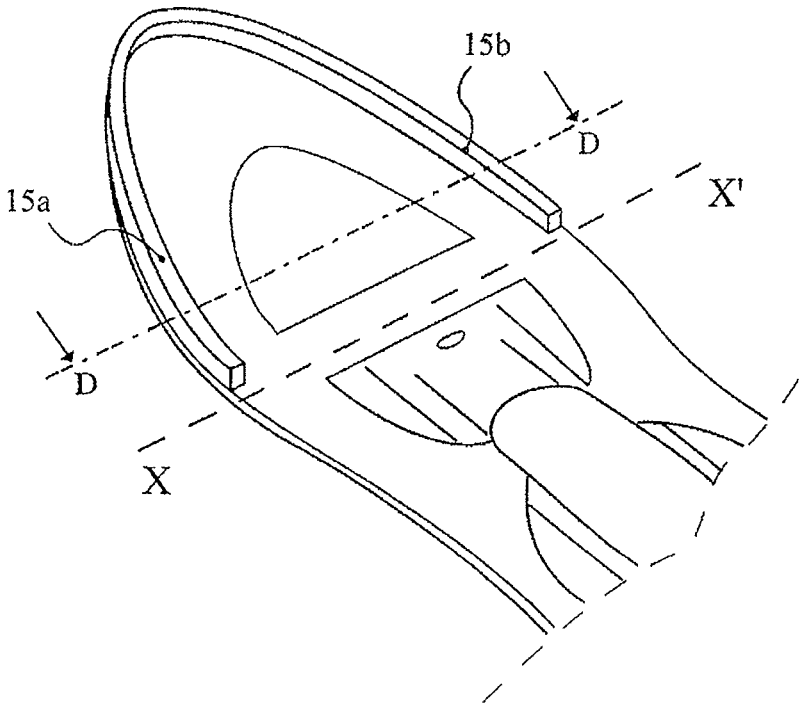
Figure 14A:
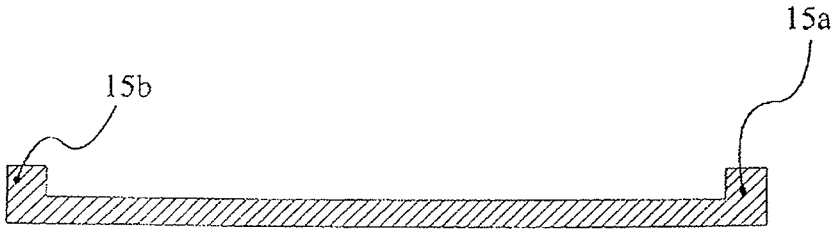

FIG. 12 illustrates the type of flexibility retained;

FIG. 13 is a simplified lateral view showing the cooperation of the deck with the complementary elements FIGS. 14 and 14*a* illustrate an exemplary embodiment of the front portion.

According to a preferred embodiment, the snowshoe designated by the general reference numeral (1) is in the form of an elongated plate referred to as the deck (2), on which a binding (3) for retaining the boot (4) of the user is mounted.

As known, the deck (2) is comprised of an elongated plate comprising a front portion referred to as the tip (6), extended rearward (AR) by a rear part (57). Notably, the front portion (6) is curved upward to form the tip, and said front portion starts from the curvature imparted to this portion.

Notably, the rear part (57) is comprised a central portion (5) extended rearward by a rear portion (7) forming the tail of the snowshoe.

According to the invention, the rear portion of the deck (2) is flexible at least longitudinally and at least in the central portion (5), whereas the front portion (6) of the deck (2) is rigid so as to be less flexible than the rear part (57), i.e., the other portions, including the central portion and the rear portion.

Notably, the deck (2) forms a general lower surface for support on the snow (8) to prevent the user from sinking deep into the snow, due to the relatively large load-bearing surface of the deck which, in any case, is larger than the lower surface of the boot sole.

Notably, according to the illustration given by way of example, the binding (3) adapted to retain the boot is hinged relative to the deck (2) of the snowshoe itself, along a transverse axis (XX').

Advantageously, said binding, designated by the general reference numeral (3), is comprised of a hinged plate (9) including boot-retaining mechanisms, namely, front retaining mechanisms (10) for retaining the front end of the boot and rear retaining mechanisms (11) for retaining the rear end of said boot.

Additionally, the front portion (6) forming the tip is the portion extending forward, according to the embodiment illustrated by way of example, substantially from the transverse pivoting axis (X, X') of the hinged plate (9).

According to one of the embodiments, the deck (2) is longitudinally flexible in its central portion (5) and in its rear portion (7), while the front portion constituting forming the tip (6) is rigid and at least more rigid than the remainder of the deck, in order to be deformable as illustrated in FIGS. 3, 4, 5, and 11.

Figure 1:
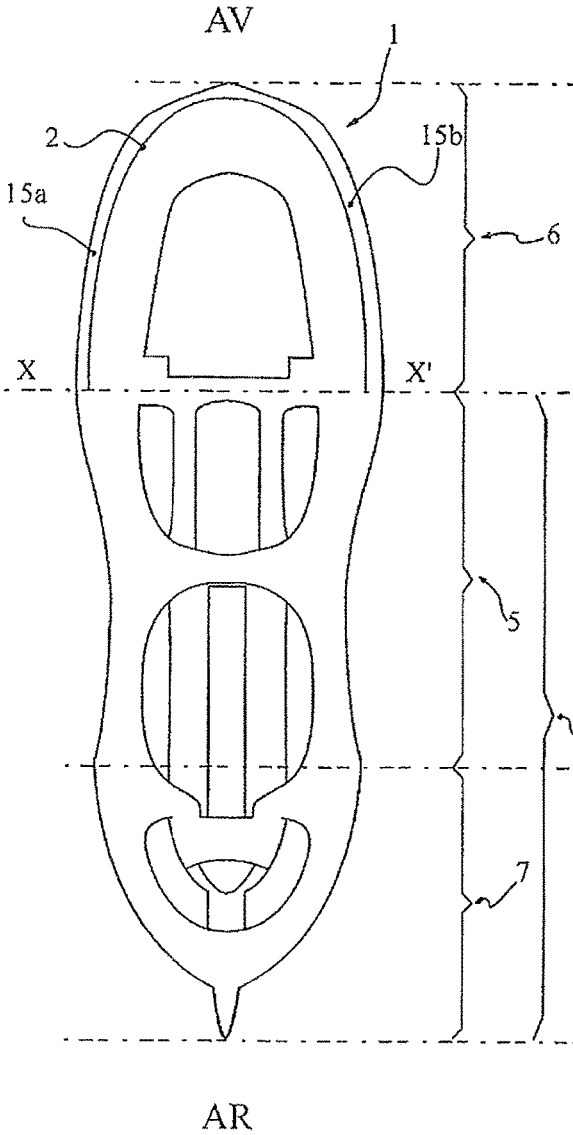
FIG. 1 is a top view of the deck of the snowshoe of the invention, without its pivoting plate binding for retaining the boot.
Figure 2:
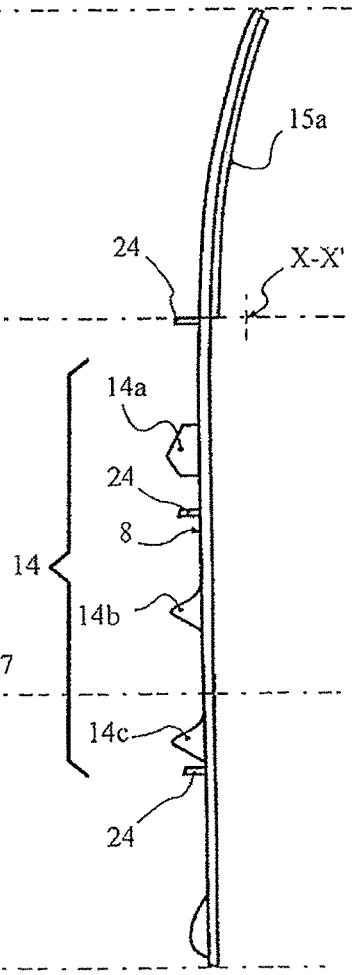
FIG. 2 is a lateral view of the deck alone, without its binding.
Figure 3:
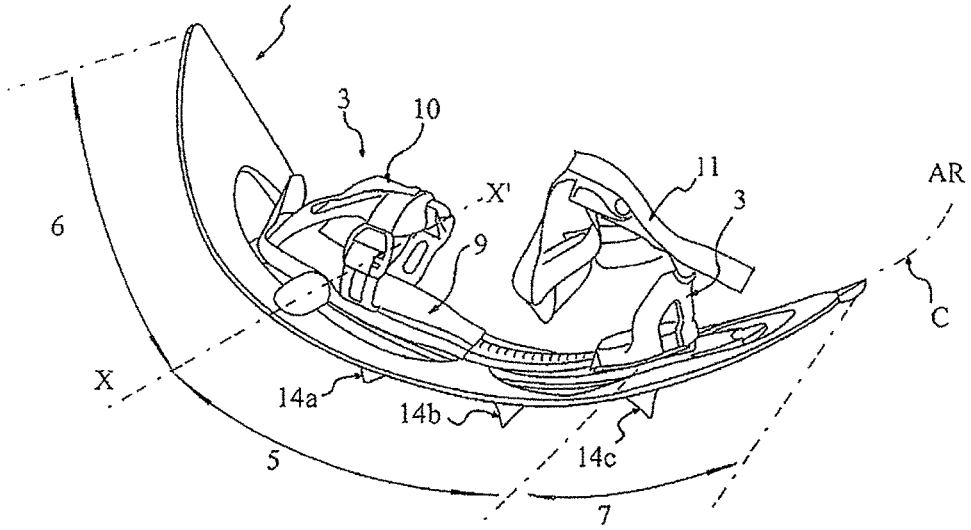
FIGS. 3, 4, 5, 6 and 7 are perspective views of the snowshoe, its deck including the binding with the boot, these being views according to various types of deformation.
Figure 4:
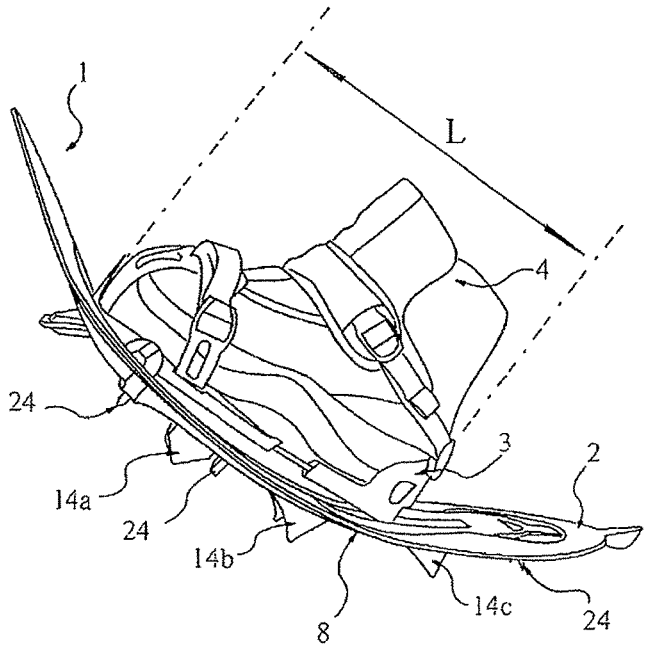
Figure 5:
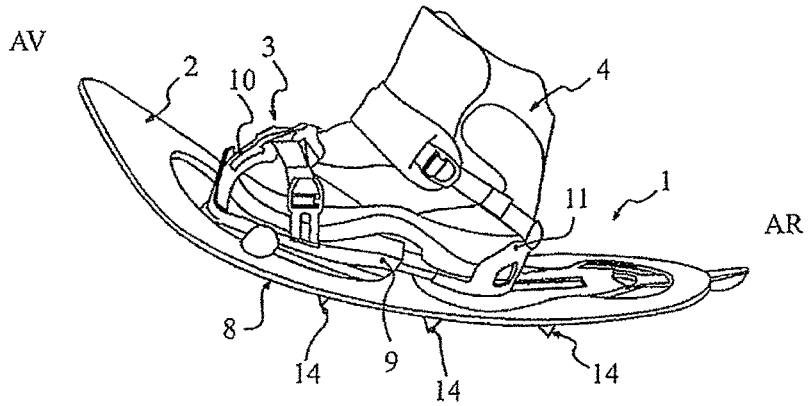
Figure 6:
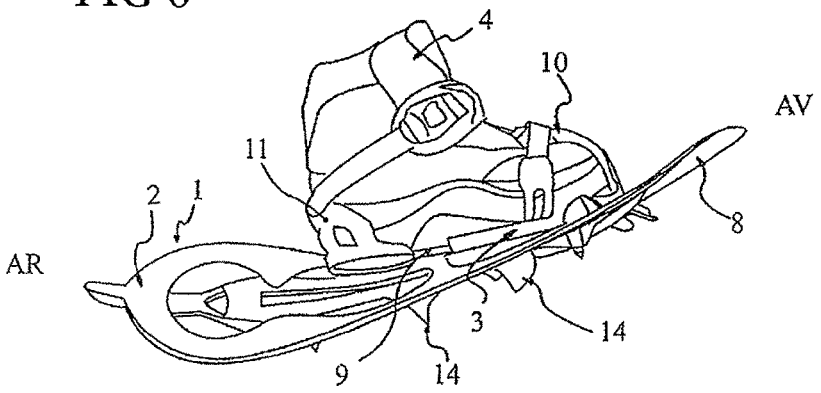
Figure 7:
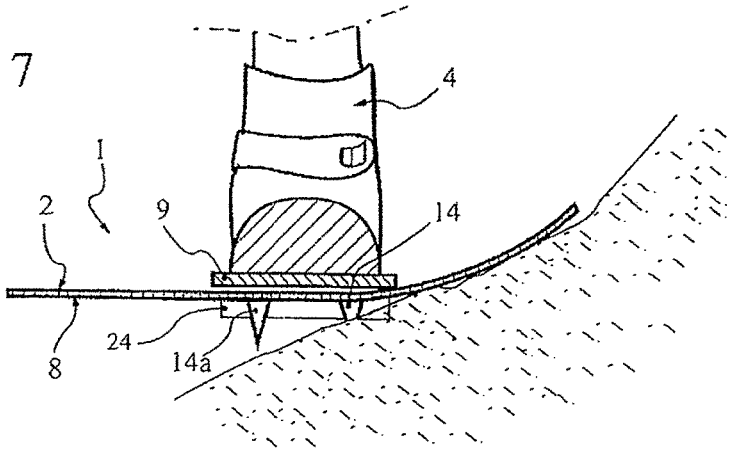

Also notable is that the deck (2) is also transversely flexible, at least in the central portion (5), in order to be deformable as shown in FIG. 6 and FIG. 7.

The longitudinal flexibility of the central portion (5) and of the rear portion (7) is such that the deformation can naturally occur continuously over the entire length, so that the deck is capable of assuming the shape of a continuous curve.

The flexibility of the central portion (5) is such that the deflection (f) is equal to or greater than 5% of the length (PC) of the central portion (5), as shown in FIG. 12.

Thus, the deck (2) is flexible in all directions, in order to give maximum comfort to the user of the snowshoe, through adaptation of the lower surface of the deck to the geometry of the snow surface.

To be flexible, the deck is made of a deformable material, such as a plastic material; for example polypropylene, polyethylene, polyamide, polyurethane.

Naturally, the deck (2) may be comprised of a stacking of layers of flexible materials of various types and/or of varying flexibility, as is the case in the manufacture of skis.

Figure 8:
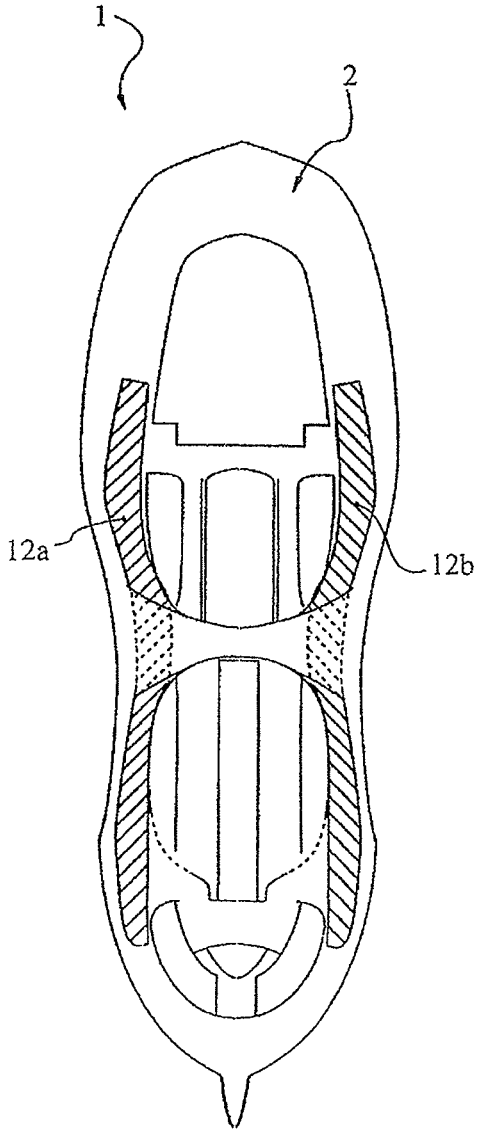
FIGS. 8 and 9 are top views of two alternative embodiments.

Of course, the constituent material of the deck may be an elastically deformable material enabling the deck to reassume its original shape. But in the case of a deck made of a non-elastically but simply deformable material which does not naturally and fully reassume its original shape, the deck (2) is equipped, for example, with complementary elements (12*a*, 12*b*; 13*a*, 13*b*) made of elastically deformable materials as shown in FIGS. 7 and 8. The complementary elements may also be mechanical mechanisms such as metallic rods having an elastic system such as possibly adjustable springs, or even made of rubber, The complementary elements are elastic elements with shape memory, forming an elastic system adapted to return the deck to its original shape after deformation. Notably, these complementary elements are longitudinal elements extending at least in the central portion (5), either in the center of the deck beneath the binding or laterally, as shown.

FIG. 8 illustrates an embodiment according to which the longitudinal complementary elements (12*a*, 12*b*) are longitudinal lateral strips made of composite materials, such as Kevlar, carbon fabric or the like. The complementary elements are advantageously fixed to the upper surface of the deck as shown. But it could be otherwise, for example under the lower surface, or even sandwiched between two constituent flexible layers of the deck.

Figure 9:
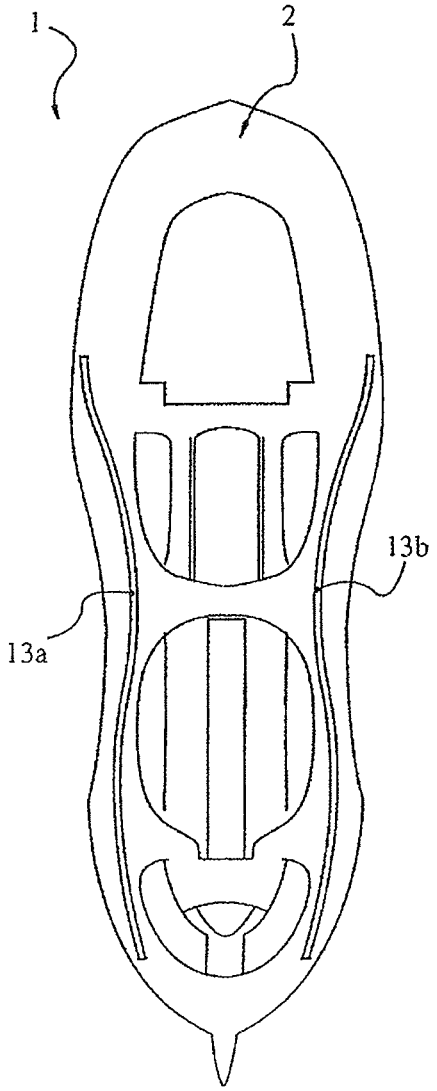

FIG. 9 illustrates another embodiment according to which the complementary elements (13*a*, 13*b*) are elastically deformable rods made, for example, of steel or composite materials made, for example, with fiber windings or the like.

According to the illustrations given by way of example, the complementary elements are arranged laterally relative to the binding pivoting plate. It could however be otherwise; for example, the complementary element(s) could be arranged in the center of the deck, beneath the binding.

When the complementary elements (12*a*, 12*b*; 13*a*, 13*b*) are on the upper surface or lower surface of the snowshoe and, therefore, not in the neutral axis of deformation, there is a relative displacement of the element relative to the deck during bending of the deck. Consequently, this relative displacement must be managed. Thus, the complementary elements are not affixed to the deck over their entire length but only at a point or over a short length (16), whereas the portions of the element that are not affixed to the deck remain free, at least in longitudinal relative displacement with respect to the deck surface; FIG. 13 is an illustration thereof given by way of example.

Snowshoes must combine criteria of lift and walking comfort, but also grip enabling the user to move in soft snow as well as on hard or icy snow, or in steep slope conditions. To this end, the deck (2) of the invention comprises a set of crampons (14) advantageously metallic, or made of very hard plastic or ceramic, and transverse ribs (24).

FIG. 10 is a bottom view of the deck with its crampons. FIGS. 10*a*, 10*b*, 10*c* show the crampons along transverse cross-sections A-A, B-B, C-C, respectively. It is understood that the particular configuration and position of the crampons make it possible to maintain the flexibility of the deck (2). Particularly notable is that the crampons are advantageously located so as to extend beneath the lower surface (8) of the deck (2) and advantageously in the area of the central portion (5) in which the zone occupied by the boot is located. Also notable is that the set of crampons is comprised of a plurality of crampons (14*a*, 14*b*, 14*c*), independent of one another to enable correct and continuous deformation of the deck. In other words, the crampons are successive such that they are not connected longitudinally in order to be independent. However, they may be connected transversely, as is the case for the crampons (14*a* and 14*b*) illustrated in FIGS. 10, 10*a* and 10*c*.

The set of crampons which, as illustrated is comprised of three pairs of crampons, is not the only option, because a lower or greater number of crampons pairs could be envisioned.

FIG. 11 is a lateral view showing the snowshoe with another type of boot retention, whereby the pivoting retaining plate (9') retaining the boot (4) of the user does not extend over the entire length (L) of the boot.

The central portion (5) of the deck (2), which is arranged between the front portion (6) and the rear portion (7), extends from the transverse pivoting axis (X, X') of the plate (9, 9'), at least over a length (L) of the boot.

The rigidity of the front portion (6) can be achieved due to stiffening ribs (15*a*, 15*b*) while the remainder of the deck is flexible, as shown by way of example in FIG. 14 and FIG. 14*a*.

Of course, the invention is not limited to the embodiments described and shown by way of examples, but also includes all of the technical equivalents and combinations thereof.

The invention claimed is:

1. A snowshoe comprising:

a deck having an elongated plate;

a binding, which is configured to retain a boot, being mounted onto the deck to pivot along a pivot axis transverse to a length of the deck;

the deck comprising a front portion extending forwardly from a location on the deck below the pivot axis to an upwardly curved tip; and a rear part comprising a central portion extending rearwardly from the front and a rear portion extending rearwardly from the central portion, wherein the central portion includes a zone in which the boot is located, wherein the rear part, at least in the central portion, is flexible at least longitudinally, and the front portion of the deck is more rigid so as to be less flexible than the rear part, and the deck further comprising a plurality of crampons independent of one another to enable correct and continuous deformation of the deck and to maintain the flexibility of the deck, wherein the central portion is capable of a deflection greater than or equal to 5% of a length of the central portion to assume a shape of a continuous curve.

2. The snowshoe according to claim 1, wherein the deck has longitudinal flexibility to be deformable along a continuous curve.

3. The snowshoe according to claim 1, wherein the deck is flexible transversely to the length of the deck.

4. The snowshoe according to claim 1, wherein the central portion is flexible in all directions, in order to give maximum comfort to the user of the snowshoe, through adaptation of the lower surface of the deck to the geometry of the snow surface.

5. The snowshoe according to claim 1, wherein the deck is made of a deformable material.

6. The snowshoe according to claim 5, wherein a constituent material of the deck is one of polypropylene, polyethylene, polyamide or polyurethane.

7. The snowshoe according to claim 1, further comprising complementary elastically deformable elements with shape memory, adapted to return the deck to its initial shape after deformation.

8. The snowshoe according to claim 7, wherein the complementary elements are longitudinal lateral strips comprised of layers of composite materials.

9. The snowshoe according to claim 7, wherein the complementary elements are longitudinal central strips comprised of layers of composite materials.

10. The snowshoe according to claim 7, wherein the complementary elements are elastically deformable longitudinal rods.

11. The snowshoe according to claim 9, wherein the complementary elements are fixed to the upper surface of the deck.

12. The snowshoe according to claim 11, wherein the complementary elements are not affixed to the deck over an entire length of the complementary elements but only at a point or on a short length, and wherein portions of the complementary elements that are not affixed to the deck remain free, at least in longitudinal relative displacement with respect to a surface of the deck.

13. The snowshoe according to claim 1, further comprising transverse ribs arranged beneath a lower surface of the deck, in the central portion.

14. The snowshoe according to claim 1, wherein the zone in which the boot is located extends rearwardly from the front portion a length to be covered by a portion of the boot extending from the binding.

15. A snowshoe comprising:

a deck having an elongated plate extending in a longitudinal direction;

a binding, which is configured to retain a portion of a boot, being mounted onto the deck to pivot along a pivot axis transverse to a length of the deck;

the deck comprising a front portion extending forwardly from a location on the deck below the pivot axis to an upwardly curved tip; and a rear part comprising a central portion and a rear portion, the central portion extending rearwardly from the front portion a length to be covered by a remaining portion of the boot extending from the binding and a rear portion extending rearwardly from the central portion, wherein, at least in the central portion, the rear part is flexible in the longitudinal direction and transversely to the longitudinal direction, and the front portion is less flexible than the rear part, the deck further comprising a plurality of crampons independent of one another to enable correct and continuous deformation of the deck and to maintain the flexibility of the deck, wherein the central portion is capable of a deflection greater than or equal to 5% of a length of the central portion to assume a shape of a continuous curve.

16. A snowshoe comprising:

a deck having an elongated plate extending in a longitudinal direction;

a binding, which is configured to retain a boot, being mounted onto the deck to pivot along a pivot axis transverse to a length of the deck;

the deck comprising a front portion extending forwardly from a location on the deck below the pivot axis to an upwardly curved tip; and a rear part comprising a central portion and a rear portion, the central portion extending rearwardly from the pivot axis to a zone over which a heel of the boot is to be located and the rear portion extending rearwardly from the central portion, wherein, at least in the central portion, the rear part is flexible at least longitudinally, so that a deflection of the central portion is greater than or equal to 5% a length of the central portion, and the front portion of the deck is more rigid so as to be less flexible than the rear part; and a plurality of crampons that are independent of one another and that are located at least on a lower surface of the deck that is below the boot occupying zone to enable correct and continuous deformation of the deck and to maintain flexibility of the deck, wherein a continuous curved shape is assumable by the deflection of the central portion.

* * * * *